United States Patent [19]

Yoon et al.

[11] 4,399,595

[45] Aug. 23, 1983

[54] MAGNETIC CLOSURE MECHANISM

[76] Inventors: John P. Yoon; Jason J. Yoon, both of 5203 Leesburg Pike, Ste. 1304, Falls Church, Va. 22041

[21] Appl. No.: 233,542

[22] Filed: Feb. 11, 1981

[51] Int. Cl.[3] ..... A44B 17/00

[52] U.S. Cl. ..... 24/201 B

[58] Field of Search ..... 24/201 R, 201 B, 303; 40/1.5

[56] References Cited

U.S. PATENT DOCUMENTS

| | | | |
|---|---|---|---|
| 2,389,299 | 11/1945 | Ellis | 24/201 B |
| 3,008,209 | 11/1961 | Kurt | 24/201 B |
| 3,102,314 | 9/1963 | Alderfer | 24/201 B |
| 3,325,869 | 6/1967 | Younger | 24/201 B |
| 3,326,399 | 6/1967 | Ausnit | 24/201 B |
| 3,919,743 | 11/1975 | Cutler | 24/201 B |
| 4,015,296 | 4/1977 | Malick | 24/201 B |

FOREIGN PATENT DOCUMENTS

| | | | |
|---|---|---|---|
| 617939 | 4/1961 | Canada | 24/201 B |
| 1217694 | 12/1959 | France | 24/201 B |

*Primary Examiner*—Gene Mancene
*Assistant Examiner*—Wenceslao J. Contreras
*Attorney, Agent, or Firm*—John J. Byrne; Bradford E. Kile

[57] ABSTRACT

Disclosed is a magnetic closure mechanism comprising two strips of flexible, non-magnetic material having magnets incorporated in them, mechanical detent means for holding strips adjacent each other such that faces having opposite polarity are adjacent each other, closing the mechanism, and means for moving the magnets relative to each other such that faces having the same polarity are brought adjacent each other, opening the mechanism.

6 Claims, 4 Drawing Figures

MAGNETIC CLOSURE MECHANISM

TECHNICAL FIELD

This invention relates broadly to closure fasteners. More specifically, it relates to a magnetic closure fastener which functions in a manner analogous to a zipper.

BACKGROUND OF THE PRIOR ART

A number of "magnetic zippers" are known in the prior art. These include those shown in:

U.S. Pat. No. 3,102,314, Alderfer; Sept. 3, 1963;
U.S. Pat. No. 3,325,869, Younger; June 20, 1967;
U.S. Pat. No. 3,326,399, Ausnit; June 20, 1967;
U.S. Pat. No. 3,919,743, Cutler; Nov. 18, 1975;
U.S. Pat. No. 4,015,296, Malick; Apr. 5, 1977.

BRIEF SUMMARY OF THE INVENTION

The subject invention is a "magnetic zipper" comprising two strips of flexible, non-magnetic material having magnets embedded in one member and slidingly received within the other, mechanical detent means for holding the strips adjacent each other such that faces having opposite polarity are adjacent each other, closing the mechanism, and means for moving the magnets relative to each other such that faces having the same polarity are brought adjacent each other, opening the mechanism.

DETAILED DESCRIPTION OF THE PRESENTLY PREFERRED EMBODIMENT

Figure 1:
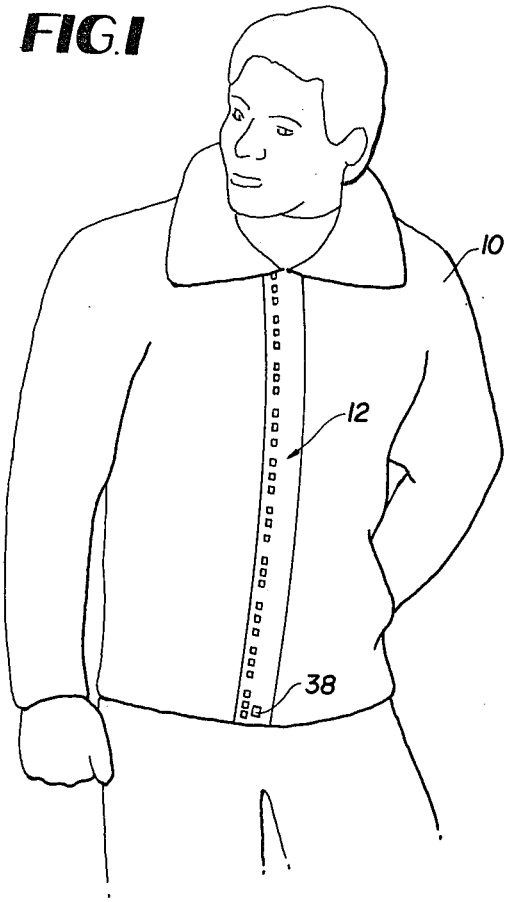
FIG. 1 is a perspective view of an individual wearing a jacket closed by a "magnetic zipper" according to this invention.
Figure 2:
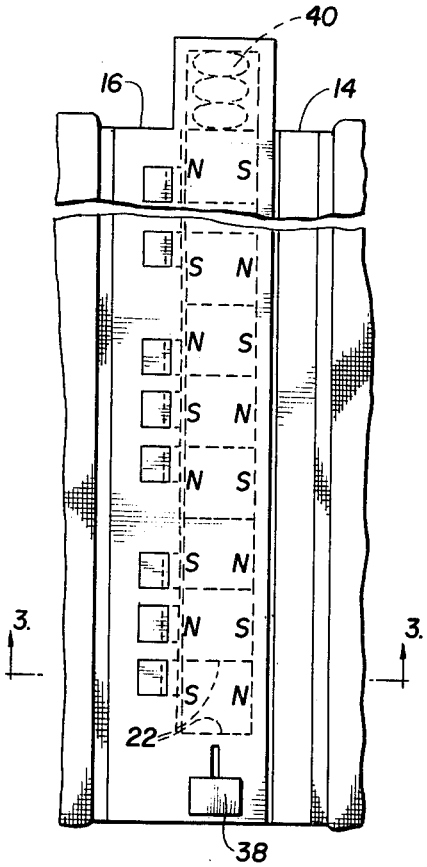
FIG. 2 is a plan view of a portion of a "magnetic zipper" according to this invention.
Figure 3:
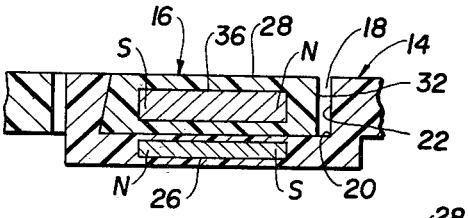
FIG. 3 is a view along the lines 3—3 in FIG. 2 showing the "zipper" in the closed position.
Figure 4:
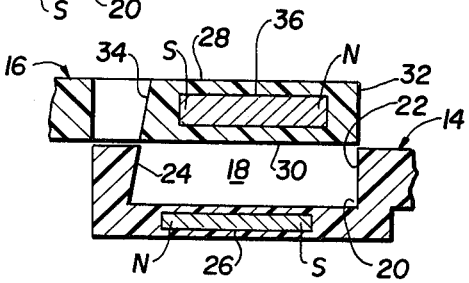
FIG. 4 is a view similar to FIG. 3 except showing the "zipper" in the open position.

FIG. 1 shows an individual wearing a jacket 10 closed by a "magnetic zipper" 12 according to this invention. As better seen in FIGS. 2 through 4, the "magnetic zipper" 12 comprises a first strip of flexible, non-magnetic material 14 and a second strip of flexible, non-magnetic material 16. The flexible, non-magnetic material is preferably plastic, but it could be any other appropriate material which is sturdy, flexible, and does not interfere with the operation of the magnets.

The first strip 14 has a longitudinally extending recess or depression 18. The recess 18 is rectangular in plan, having a flat bottom 20, and a back wall 22. A series of upwardly projecting tabs 24 are integrally fashioned on an outer edge of the strip 18 and preferably slant at an inner edge in the direction of wall 22.

A first set of magnets 26, preferably in the form of bar magnets, are embedded in the strip 14 beneath the recess 18. The magnets 26 are alternately oriented so that faces having the opposite polarity are positioned in succession beneath the recess 18. The alternating patterns can consist of short segments repeated at spaced intervals, or it can consist of regular and continuing alternations all the way along the "zipper."

The second strip 16 has a longitudinally extending protrusion position on strip 28. The protrusion strip 28 is also rectangular in plan, has a flat inner surface 30 and a forward wall 32. A plurality of recesses or openings 34 are fashioned in series along the protrusion strip 28 and conform in size and number and spacing to internally recieve tabs 24. In this connection an inwardly looking surface is slated to cooperate with the inner edges of tabs 24.

The protrusion strip 28 is sized and shaped, so that it will fit into the depression strip 18 and so that the slanted walls of the tabs and recesses 24 and 34 respectively will fit flat against each other while the flat inner surface 30 of the protrusion strip 28 fits against the flat portion 20 of the depression 18. Accordingly, the strips 14 and 16 are mechanically joined together against forces acting to pull the strips apart. Such forces merely tending to force the slated walls of the tabs and recesses 24 and 34 closer together.

A second set of magnets 36, preferably in the form of bar magnets, are slidably placed within the protrusion strip 28. The magnets 36 are alternately oriented so that faces having a polarity opposite to the polarity of the adjacent face of the magnets 26 embedded in the first strip 14 are positioned beneath the upper surfaces of the protrusion strip 28 when the strips 14 and 16 are in a closed position.

A disengage tab or means 38 extends through a slot in the strip 16 for moving the magnets 36 longitudinally within the strip 16. In this connection when magnets 36 are indexed one position faces having the same polarity from the two sets of magnets are brought adjacent to each other. The protrusion strip 28 is thereby magnetically pushed out of the recess strip 18 thus releasing tabs 24 from recesses 34. Resilient means 40, comprising a spring, bias the set of magnets 36 towards a closed position and operably return the magnets to a closed position upon release of the disengage means 38.

Although a single means 38 which opens all of the magnetic pairs at once is shown, it would obviously be possible to provide a separate means 38 for each magnet pair so that the closure could be opened (or closed) part way. In that case, the closure fastner would function more like a set of magnetic buttons than like a magnetic zipper.

Caveat

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

We claim:

1. A magnetic closure mechanism comprising:

a first strip of flexible, non-magnetic material having;

a longitudinally extending recess, said recess being rectangular in plan view, and having a flat bottom, and a series of upwardly extend tabs along an outer edge of the strip, and a first set of magnets embedded beneath said recess within said first strip, said magnets being alternately oriented so that faces are adjacent having the opposite polarity;

a second strip of flexible, non-magnetic material having;

a longitudinally extending protrusion, said protrusion being rectangular in plan view and having a flat inner portion, and a series of recesses, said recesses being sized, shaped, and spaced to receive said tabs on said first strip whereby said strips are mechanically joined together against forces acting away from the strips, and a second set of magnets slidably placed within said second strip, said magnets being alternately oriented so that faces having a polarity opposite to the polarity of the adjacent face of the magnets embedded in said first strip are juxtaposed when said first and second strips are in a closed position; and means for moving said second set of magnets longitudinally within said second strip so that facing magnets have in said two strips the same polarity, thus magnetically pushing said tabs out of said recesses and releasing the first and second strips.

2. A magnetic closure mechanism as recited in claim 1 wherein the non-magnetic material of which said first strip is made is plastic.

3. A magnetic closure mechanism as recited in claims 1 or 2 wherein the non-magnetic material of which said second strip is made is plastic.

4. A magnetic closure mechanism as recited in claim 1 wherein said first set of magnets are bar magnets.

5. A magnetic closure mechanism as recited in claim 1 or 4 wherein said second set of magnets are bar magnets.

6. A magnetic closure mechanism as recited in claim 1 and further comprising resilient means longitudinally biasing said second set of magnets to move within said second strip towards a position operable to magnetically induce closure of said first and second strips and engagement of said tabs with said recesses.

* * * * *